US008193142B2

(12) United States Patent
Lalgudi et al.

(10) Patent No.: US 8,193,142 B2
(45) Date of Patent: Jun. 5, 2012

(54) COMPOSITION

(75) Inventors: Ramanathan S Lalgudi, Westerville, OH (US); Rob J Cain, Lewis Center, OH (US)

(73) Assignee: Battelle Memorial Institute, Columbus, OH (US)

( * ) Notice: Subject to any disclaimer, the term of this patent is extended or adjusted under 35 U.S.C. 154(b) by 0 days.

(21) Appl. No.: 12/550,660

(22) Filed: Aug. 31, 2009

(65) Prior Publication Data

US 2011/0053825 A1 Mar. 3, 2011

(51) Int. Cl.

| | |
|---|---|
| ***C11D 3/37*** | (2006.01) |
| ***C11D 3/386*** | (2006.01) |
| ***C11D 3/395*** | (2006.01) |
| ***C11D 17/00*** | (2006.01) |

(52) U.S. Cl. ..... 510/349; 510/302; 510/320; 510/367; 510/392; 510/441; 510/530; 252/186.25

(58) Field of Classification Search ..... 510/302, 510/320, 349, 367, 392, 441, 530; 252/186.25
See application file for complete search history.

(56) References Cited

U.S. PATENT DOCUMENTS 4,973,417 A * 11/1990 Falholt ..... 510/530

FOREIGN PATENT DOCUMENTS

WO WO 2010/040982 * 4/2010

* cited by examiner

*Primary Examiner* — Brian P Mruk

(74) *Attorney, Agent, or Firm* — Norris McLaughlin & Marcus PA

(57) ABSTRACT

A cleaning composition comprises a dispersion. The dispersion includes an acidic aqueous phase and a suspended particle. The particle is coated with an acid stable coating.

18 Claims, No Drawings

COMPOSITION

This invention relates to cleaning compositions and cleaning methods.

Consumers are aware that in order to achieve effective cleaning of household items a multitude of different cleaning agents have to be incorporated into a single cleaning composition. As examples bleaches are used to oxidise/decolourise stains; surfactants are used to solubilise grease and water softening agents are used to soften hard water.

One major problem with the preparation of a complex admixture of components is to ensure that all components are stabilised in the admixture so that they are not denatured between the point of manufacture and the point of use.

This problem is particularly prevalent wherein the detergent composition includes components which are antagonistic towards other detergent components. In this regard bleaches are case in point: typically they bring about oxidative destruction of many other detergent components. A further example is pH: often a pH which brings about stability of one component may bring about the eradication of another.

One way to address this problem is to keep the components having different storage requirements separate until their point of use. This is relatively facile when the both components are in solid form since a separate environment for the two components can easily be created. Thus cleaning powders and compressed particulate tablets can be produced which contain multiple ingredients in solid form. Additionally often the components requiring different storage environments are segregated with the composition as a further aid to prevent premature reaction.

However, certain cleaning preparations require the use of a liquid formulation. In such a case the facile separation solution cannot easily be achieved since the components are free to migrate within the liquid and will, if they come into contact, react with one another.

In this case traditionally it has been necessary to provide liquid cleaning formulations in multi-chamber packs, wherein one chamber contains one component and a second chamber contains another component, so that different storage environments are created and the components are only brought into contact at the point of use. Such twin chamber packs are expensive to manufacture and cumbersome in use, requiring an unnecessary burden of dexterity from a consumer.

It is an object of the present invention to obviate/mitigate the disadvantages described above.

According to a first aspect of the present invention there is provided a cleaning composition comprising a dispersion, including an acidic aqueous phase and a suspended particulate, wherein the particle is coated with an acid stable coating.

With the use of a composition in accordance with the present invention it has been found that a liquid formulation may be provided which displays excellent stability before use and outstanding performance in use due to the combination of coating and coated particle. Additionally the exceptional performance is imparted without the need for a complex multi-chamber sales pack.

The coating generally comprises an acid resistant coating such as (but not limited to) a carboxylate/carboxylic acid polymer.

Preferred examples of the carboxylate/carboxylic acid polymer include alkenoic acids (such as acrylic acid); alkyl acrylic acid (such as methacrylic acid, di methyl acrylic acid, propyl acrylic acid and ethyl acrylic acid); 1-cyclopentene-1-carboxylic acid; methyl pentenoic acid, 2-cyano-3-methyl-but-2-enoic acid; itaconic acid; mesaconic acid; citraconic acid; 4-vinyl benzoic acid; and mixtures thereof.

Preferably the polymer is cross-linked.

Generally the cross-linker includes one or more of the following chemical moieties.

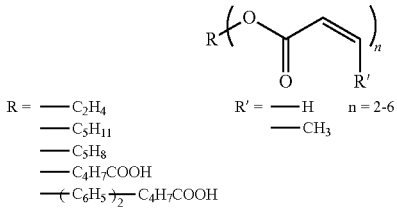

Preferred examples of cross-linking agents include ethylene glycol dimethacrylate, trimethylol propane trimethacrylate, acrylated pentaerythrytol, acrylated dimethylol pripionic acid, acrylated 4,4-Bis(4-hydroxyphenyl) valeric acid.

Preferably 0.5 to 30 wt % of the cross-linker is present.

Additives and auxiliary ingredients may be added to the coating. Typical additives are plasticizers, which improve the quality of the coating making it more flexible and thus adapting it to the surface texture and increasing coating mechanical stability. Suitable plasticizers include (but are not limited to) polycarboxylic acid alkyl esters or polyethylene glycols or polypropylene glycols.

Preferably the plasticizer comprises citric acid triethyl ester or sebacic acid dibutyl ester or adipic acid diisopropyl ester, diethylene glycol or dipropylene glycol.

Most preferably the plasticizer comprises adipic acid diisopropyl ester or dipropylene glycol. Preferred commercially available examples of such plasticizers include Crodamol DA and DOW Dipropylene Glycol.

Generally the coating is applied in a method in which the coating is solubilised in a solvent, such as water or a single/mixture of organic solvents and dried onto the particle.

A preferred method to apply the coating is via fluid bed processing, either batch or continuous. In this method the particles to be coated are loaded into a fluid bed equipment, fluidised through an air flow and sprayed with a solution containing the coating. Solution spraying can be either bottom spraying or top spraying, depending on specific needs. The sprayed solution is then dried onto the particles by the air flow.

In an embodiment of the present invention the acidic monomer is mixed with the particles to be coated and polymerized under UV polymerization to produce acidic polymer coating onto the particles.

In yet another embodiment of the present invention the particles to be coated is suspended in a medium (such as an organic solvent) that includes that acidic monomer and a polymerization initiator. Upon polymerization the acidic polymer is coated onto the particles.

Generally the particle has a particle size of between 10 and 2000 microns, preferably between 100 and 1500 microns and most preferably between 500 and 1000 microns.

Preferably the particle comprises a builder such as an acrylate/acrylic polymer; an enzyme such as a lipase, protease, amylase, mannanase; or a bleaching agent such as sodium percarbonate (PCB), tetra acetyl ethylene diamine (TAED), ϵ-phtalimido-peroxyhexanoic Acid (PAP).

Preferably the aqueous phase comprises at least 90% by weight of the composition.

The particle preferably comprises at least 0.1% of the composition.

Preferably the composition comprises at least 0.01% by weight surfactant, preferably at least 0.05%, more preferably at least 0.1% and most preferably at least 0.2% by weight.

The cleaning composition desirably includes at least one surfactant selected from anionic, cationic, non-ionic or amphoteric (zwitterionic) surfactants.

The particulate and or aqueous phase of the composition may contain other detergent actives such as bleaching agents, enzymes, builders, perfumes, optical brighteners, soil suspending agents, dye transfer inhibition agents.

According to the second aspect of the invention there is provided the use of a cleaning composition comprising a dispersion, including an acidic aqueous phase and a suspended particle, wherein the particle is coated with an acid stable coating, in a cleaning operation.

It will be understood that features of the first aspect of the invention will be taken to apply mutatis mutandis to the second aspect of the invention.

It has been found that in use the particles coating breaks down due a change in pH.

The use is preferably associated with a washing machine and be for mechanical laundry and/or dishwashing. The use may also be for hand washing e.g. manual laundry.

The invention will now be illustrated with reference to the following non-limiting Example.

EXAMPLE A

The following procedure was used for the preparation of particles that deliver the active ingredient in the wash bath solely.

2 grams of acrylic acid polymer, 0.5 grams of trimethylolpropane triacetate, 5 grams of methyl ethyl ketone, 0.05 grams methyl hydroquinone, 0.022 grams 2,2-dimethoxy-1, 2-diphenyl-ethanone (Irgacure 651) were added to a 250 ml round bottomed flask. 7.5 grams TAED was also added and the mixture was stirred.

The solvent was evaporated and the solid was transferred to a metal pan where it was cured under U/V light.

EXAMPLE B

The following procedure was used for the preparation of particles that deliver the active ingredient in the wash bath solely.

210 grams of mineral oil, 140 grams of toluene, 7 grams of stabiliser (poly(lauryl methacrylate-polyethylene oxide), 70 grams TAED was also added and the mixture was stirred at 60° C.

In a separate beaker 70 grams of acrylic acid polymer, 2.1 grams of trimethylolpropane triacetate, 3.5 grams of poly (lauryl methacrylate-polyethylene oxide) 1.4 grams of AIBN and 25 ml of toluene were combined and mixed until all solids had dissolved.

The second mixture was added to the first and was stirred for 13 hour 15 minutes at 60° C.

The product was isolated by filtering off the microcapsules.

The encapsulation efficiency was found to be 60-70% and it was found that the particles are in the size range from 50 to 100 microns and could be ruptured at a pH of 8.0.

The invention claimed is:

1. A cleaning composition comprising a dispersion, including an acidic aqueous phase and a suspended particle, wherein the particle is coated with an acid stable coating selected from a crosslinked carboxylate/carboxylic acid polymer wherein the cross-linker of the polymer includes one or more of the following chemical moieties;

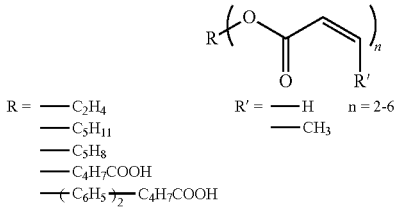

2. A cleaning composition according to claim 1, wherein the carboxylate/carboxylic acid polymer is selected from: acrylic acid, alkyl acrylic acid, 1-cyclopentene-1-carboxylic acid; methyl pentenoic acid, 2-cyano-3-methyl-but-2-enoic acid; itaconic acid; mesaconic acid; citraconic acid; 4-vinyl benzoic acid; and mixtures thereof.

3. A cleaning composition according to claim 1, wherein the coating is applied in a method in which the coating is solubilised in a solvent and dried onto the particle.

4. A cleaning composition according to claim 1, wherein the particle has a particle size of between 10 and 2000 microns.

5. A cleaning composition according to claim 1, wherein the particle comprises an enzyme or a bleaching agent.

6. A composition according to claim 1, wherein the aqueous phase comprises at least 90% by weight of the composition.

7. A composition according to claim 1, wherein the particulate comprises at least 0.1% by weight of the composition.

8. A method of cleaning a surface, comprising applying a cleaning composition according to claim 1 comprising a dispersion, including an acidic aqueous phase and a suspended particle, wherein the particle is coated with an acid stable coating.

9. A cleaning composition according to claim 4, wherein the particle has a particle size of between 100 and 1500 microns.

10. A cleaning composition according to claim 9, wherein the particle has a particle size of between 500 and 1000 microns.

11. A cleaning composition according to claim 2, wherein the coating is applied in a method in which the coating is solubilised in a solvent and dried onto the particle.

12. A cleaning composition according to claim 11, wherein the particle has a particle size of between 10 and 2000 microns.

13. A cleaning composition according to claim 1, wherein the coating is applied in a method in which the coating is solubilised in a solvent and dried onto the particle.

14. A cleaning composition according to claim 13, wherein the particle has a particle size of between 10 and 2000 microns.

15. A cleaning composition according to claim 2, wherein the particle comprises an enzyme or a bleaching agent.

16. A cleaning composition according to claim 1, wherein the particle comprises an enzyme or a bleaching agent.

17. A composition according to claim 2, wherein the aqueous phase comprises at least 90% by weight of the composition.

18. A composition according to claim 1, wherein the aqueous phase comprises at least 90% by weight of the composition.

* * * * *